US006798892B2

(12) United States Patent
Parnell

(10) Patent No.: US 6,798,892 B2
(45) Date of Patent: Sep. 28, 2004

(54) ROTATABLE REMOVEABLE SPEAKER ASSEMBLY

(76) Inventor: Scott David Parnell, 3755 NW. Sierra Dr., Camas, WA (US) 98607

( * ) Notice: Subject to any disclaimer, the term of this patent is extended or adjusted under 35 U.S.C. 154(b) by 198 days.

(21) Appl. No.: 10/167,007

(22) Filed: Jun. 10, 2002

(65) Prior Publication Data

US 2003/0228028 A1 Dec. 11, 2003

(51) Int. Cl.[7] ..... A04R 25/00

(52) U.S. Cl. ..... 381/386; 381/389; 381/394; 381/395; 381/387; 181/199

(58) Field of Search ..... 381/332, 386, 381/387, 389, 394, 395; 181/199; 439/45, 49, 52, 53, 94, 97, 105, 503, 504, 746

(56) References Cited

U.S. PATENT DOCUMENTS 5,937,073 A * 8/1999 Van Gieson ..... 381/391

* cited by examiner

*Primary Examiner*—Huyen Le
*Assistant Examiner*—Dionne Harvey
(74) *Attorney, Agent, or Firm*—Glenn C. Brown, P.C.

(57) ABSTRACT

A speaker assembly a speaker assembly that is readily mounted and dismounted from a mounting bar, and which also achieves reliable electrical connection in the same mounting connection. To mount the speaker, one pulls a plunger pin out, inserts a mounting boss into a swivel mount, and releases the plunger pin to lock the speaker onto the swivel mount. This action also inserts a jack into a receptacle, and completes the electrical connection of the speaker to the music source. The speaker is then rotated to the desired position and fixed in place by tightening a thumb screw.

3 Claims, 2 Drawing Sheets

ROTATABLE REMOVEABLE SPEAKER ASSEMBLY

This invention relates to loudspeakers, and in particular to loudspeakers for boats, automobiles and other outdoor locations, and which can be easily mounted and dismounted to protect them from weather, vandalism or theft.

Many boats and other outdoor recreational or work vehicles are equipped with radios or various other types of entertainment systems. The systems include speakers of course, and in many instances the speakers are mounted on outdoor portions of the vehicle. On a boat for instance, it is common for the main portion of the entertainment system to be mounted in a weather protected space, while speakers are mounted on external supports to project to the outdoor deck portions of the boat. This presents several potential problems. When the boat for example is unattended, the externally mounted speakers are vulnerable to theft or vandalism, and can be damaged by unexpectedly severe weather conditions. The problem is exacerbated where higher quality speakers are used, and are a more attractive target for thieves.

Speakers can be temporarily placed in outdoor locations in a variety of ways, but none provide a combination of secure mounting, adjustability, and easy mounting and removal that is necessary for use on boats and other types of recreational equipment.

DESCRIPTION OF THE PREFERRED EMBODIMENTS

Figure 1:
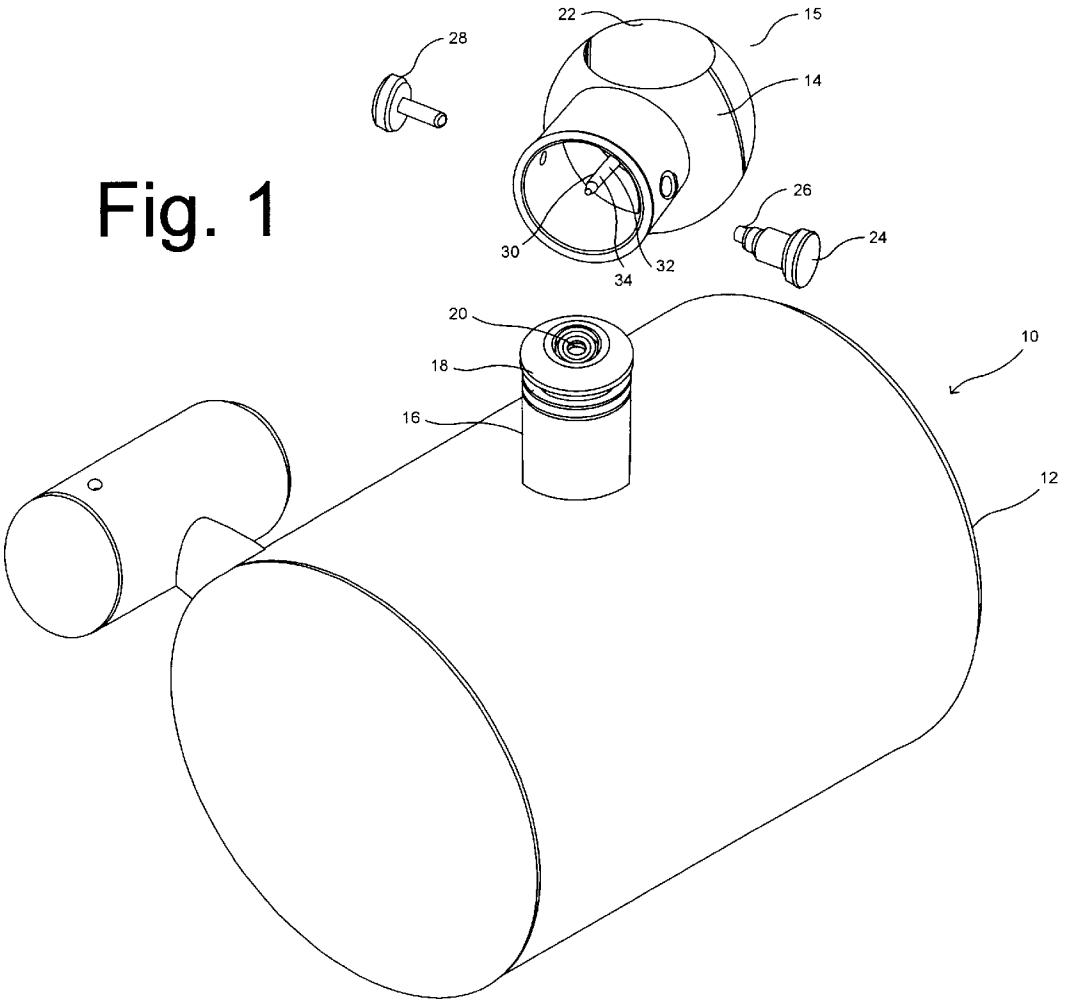
FIG. 1 is an exploded perspective view of a preferred embodiment of the invention.

Turning now to the drawings, a preferred embodiment of the invention is shown generally at 10, and includes a speaker body 12, and a mounting bracket 15. Speaker body 12 includes a mounting boss 16 protruding from the speaker body, and which includes a retaining groove 18, and a connector receptacle 20. Mounting bracket 15 comprises a swivel mount 14 which includes a clamp portion 22 that receives and clamps to a mounting bar (not shown) on a boat for example. An operable plunger pin 24 is mounted in the swivel mount 14, and includes a distal portion 26 that is biased into a position where it engages retaining groove 18, and locks the speaker into the swivel mount. A set screw 28 is also provided for fixing the speaker in a desired position around the 360 range of swivel motion provided by the swivel mount. The plunger pin 24 is shown in FIG. 1 in the retracted position, wherein the plunger pin 24 is disengaged from the groove 18.

Figure 3:
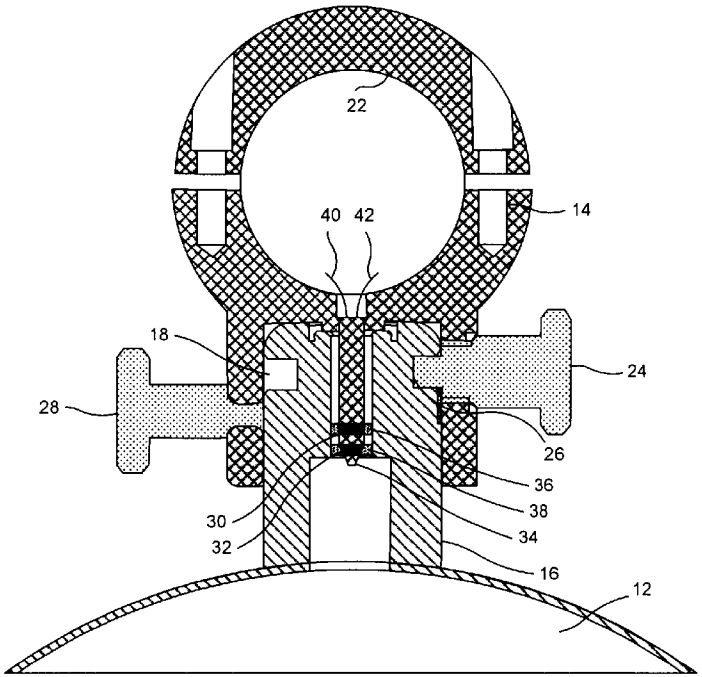
FIG. 3 is a partial cross-sectional view along line A—A in FIG. 2.
Figure 2:
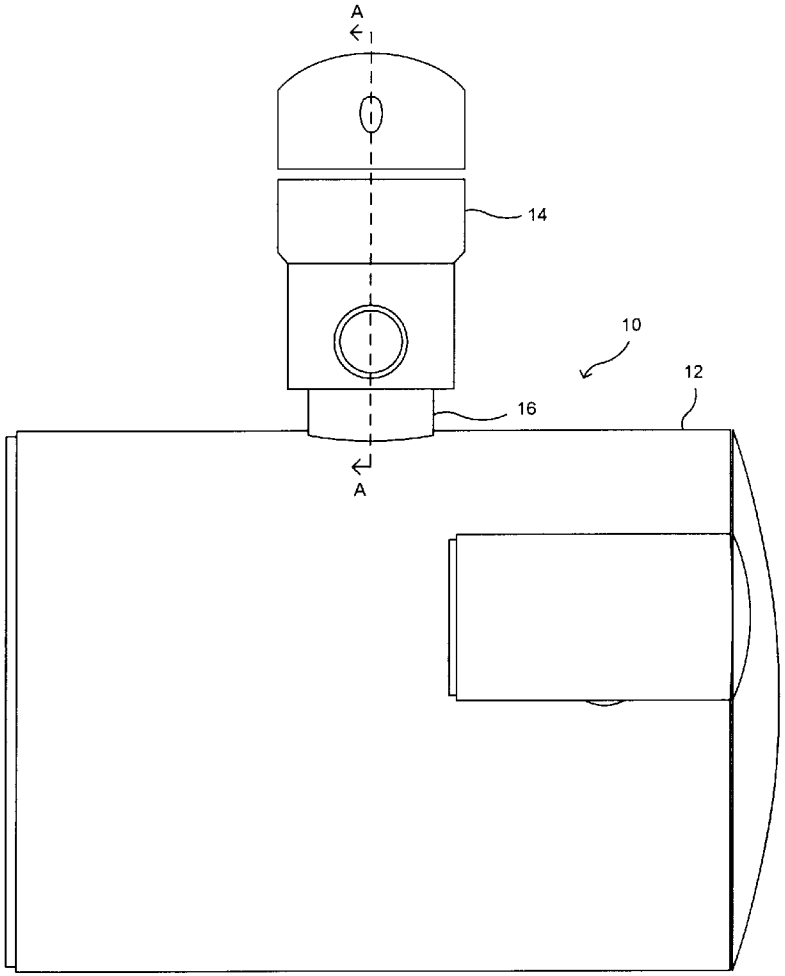
FIG. 2 is a side elevational view of the embodiment shown in FIG. 1.

The invention includes an electrical connector assembly that provides easy and reliable electrical contact between speaker wires extending from the signal source and through the mounting bar. Turning to FIG. 3, the swivel mount 14 includes a round electrical jack 34 that includes two separate, isolated electrical connection areas 30, 32 for signal and ground connections respectively. The electrical connection areas 30, 32 extend around the circumference of the electrical jack 34, and engage corresponding connections 36, 38 in the mounting boss 16. The corresponding connections 36, 38 in the mounting boss are in electrical communication with corresponding connections on the loudspeaker (s) (not shown) mounted in the speaker assembly. In the embodiment shown, the speaker wires 40, 42 pass through the mounting bar and swivel mount 14 to connect to the electrical jack 34. In other embodiments, the mounting bar includes electrical connection pads extending through the wall of the mounting bar, and that engage corresponding electrical connection pads on the inside surface of the swivel mount when the swivel mount is positioned in a predetermined position on the mounting bar. The electrical connection pads in the inside surface of the swivel mount are electrically connected to the electrical jack.

In operation, the invention provides a speaker assembly that is readily mounted and dismounted from the mounting bar, and which also achieves reliable electrical connection in the same mounting connection. To mount the speaker, one pulls the plunger pin out, inserts the mounting boss into the swivel mount, and releases the plunger pin to lock the speaker onto the swivel mount. This action also inserts the jack into the receptacle, and completes the electrical connection of the speaker to the music source. The speaker is then rotated to the desired position and fixed in place by tightening the thumb screw. Removal is simply the reverse of the installation process.

The speaker housing, mounting boss and swivel mount can be of different shapes and sizes, and are not limited to the embodiment shown in the figures. The materials of construction are preferable metal or plastic, but once again, the invention is not limited to any particular material of construction. The electrical jack as shown is one suitable design, but is intended to be illustrative and not to limit the scope of the invention.

The foregoing description is intended to illustrate preferred embodiments of the invention, rather than to limit the invention. Those skilled in the art will recognize that numerous modifications in arrangement and detail are possible without departing from the scope of the invention.

What is claimed is:

1. A loudspeaker and mounting assembly comprising:

a speaker assembly including at least one speaker and a mounting boss, the mounting boss including a first engageable electrical connector in communication with the at least one speaker;

a mounting bracket including a first portion connectable to a support, and a second engageable electrical connector in communication with the output of an amplifier;

the mounting boss and the mounting bracket rotatably engageable; and, the first and second engageable electrical connectors removeably engageable and rotatable relative to each other, wherein the first engageable electrical connector concentrically surrounds the second engageable electrical connector wherein the mounting boss includes an outer circumferential groove, and wherein the mountig bracket includes an operable member having a first extended position engaged with the outer circumferential groove and a second retracted position disengaged from the outer circumferential groove.

2. A loudspeaker and mounting assembly according to claim 1 wherein the speaker assembly mounting boss further comprises a cylindrical member having an outer circumferential groove and an inner surface defining the first electrical connector, the first electrical connector including an inner cylindrical surface having first and second electrical contacts in communication with input terminals of the at least one speaker.

3. A loud speaker and mounting assembly according to claim 2 wherein the second electrical connector comprises an elongate member engageable with the first electrical connector, and further comprising third and fourth outer circumferential electrical contacts positioned to engage the respective first and second electrical contacts on the first electrical connector when the first and second electrical connectors are engaged, the third and fourth electrical contacts engageable with the respective first and second electrical contacts throughout a rotation of the speaker assembly through at least 180 degrees of rotation relative to the mounting bracket.

* * * * *